US007746318B2

(12) United States Patent
Shin et al.

(10) Patent No.: US 7,746,318 B2
(45) Date of Patent: Jun. 29, 2010

(54) LIQUID CRYSTAL DISPLAY BACKLIGHT INVERTER

(75) Inventors: Sang Cheol Shin, Gyunggi-do (KR); Byoung Own Min, Gyunggi-do (KR); Chang Woo Ha, Gyunggi-do (KR); Jung Chul Gong, Seoul (KR)

(73) Assignee: Samsung Electro-Mechanics Co., Ltd, Suwon, Gyunggi-Do (KR)

( * ) Notice: Subject to any disclaimer, the term of this patent is extended or adjusted under 35 U.S.C. 154(b) by 493 days.

(21) Appl. No.: 11/695,222

(22) Filed: Apr. 2, 2007

(65) Prior Publication Data

US 2007/0228991 A1 Oct. 4, 2007

(30) Foreign Application Priority Data

Apr. 4, 2006 (KR) ..... 10-2006-0030568

(51) Int. Cl.
*G09G 3/36* (2006.01)

(52) U.S. Cl. ..... 345/102

(58) Field of Classification Search ..... 345/55–102, 345/204–214, 690–697; 315/169.3, 169.4
See application file for complete search history.

(56) References Cited

U.S. PATENT DOCUMENTS

| | | | | |
|---|---|---|---|---|
| 6,151,232 | A | 11/2000 | Furuhashi et al. | |
| 6,445,143 | B1 * | 9/2002 | Min | 345/102 |
| 6,504,315 | B2 * | 1/2003 | Kim | 315/224 |
| 7,236,375 | B2 | 6/2007 | Fukumoto | |
| 2005/0057170 | A1 * | 3/2005 | Yu et al. | 345/102 |

FOREIGN PATENT DOCUMENTS

| | | | |
|---|---|---|---|
| CN | 1620747A | A | 5/2005 |
| JP | 08-078180 | A | 3/1996 |
| JP | 10-223391 | A | 8/1998 |
| JP | 2000-184727 | A | 6/2000 |
| KR | 10-0431267 | B1 | 4/2004 |

OTHER PUBLICATIONS

Japanese Patent Office, Office Action issued Dec. 8, 2009.
Chinese Patent Office, Office Action issued Jun. 27, 2008.

* cited by examiner

*Primary Examiner*—David L Lewis
(74) *Attorney, Agent, or Firm*—Lowe Hauptman Ham & Berner

(57) ABSTRACT

An LCD backlight inverter includes a soft starter for generating a soft-start reference voltage gradually increasing as the driving power begins to be supplied. The LCD backlight inverter also includes a first error detector for receiving a first feedback voltage indicating the magnitude of driving current of the lamp and for comparing a smaller value out of a predetermined first reference voltage and the soft-start reference voltage with the first feedback voltage to generate a first error signal corresponding to the difference between the smaller value and the soft-start reference voltage. The LCD backlight inverter further includes a pulse width modulation comparator for comparing the first error signal and a triangle wave oscillation signal to output the pulse width modulation control signal with a predetermined duty ratio. The LCD backlight inverter prevents application of over-current and over-voltage to the LCD backlight to prolong the lifetime of the backlight.

3 Claims, 4 Drawing Sheets

LIQUID CRYSTAL DISPLAY BACKLIGHT INVERTER

CLAIM OF PRIORITY

This application claims the benefit of Korean Patent Application No. 2006-30568 filed on Apr. 4, 2006, in the Korean Intellectual Property Office, the disclosure of which is incorporated herein by reference.

BACKGROUND OF THE INVENTION

1. Field of the Invention

The present invention relates to a Liquid Crystal Display (LCD) backlight inverter and, more particularly, to an LCD backlight inverter capable of a soft start that allows stable supply of initial current and voltage during initial driving of an LCD backlight lamp, thereby preventing over-current or over-voltage from being applied which would otherwise damage the LCD backlight lamp.

2. Description of the Related Art

In general, display devices for computer monitors, TVs and the like include those capable of generating light on their own such as Organic Light Emitting Displays (OLEDs), Vacuum Fluorescent Displays (VFDs), FieldEmission Displays (FEDs) and Plasma Display Panels (PDP), and those incapable of generating light on their own and requiring a separate light source such as Liquid Crystal Displays (LCDs).

A general LCD includes two panels each with field-generating electrodes and an anisotropic liquid crystal layer disposed between the panels. To obtain a desired image, a voltage is applied to the field-generating electrodes to generate an electric field in the liquid crystal layer and the voltage is varied to adjust the magnitude of this electric field, thereby adjusting the transmission ratio of the light passing through the liquid crystal layer.

At this time, the LCD can use natural light, but typically uses an artificial light source (backlight) separately prepared.

The backlight of the LCD can be categorized into an edge type (side-emitting type) and a direct type. In the edge-type backlight, a bar-type light source is located at a side of the LCD panel to irradiate light via a light guide panel to the LCD panel. In the direct type, a surface light source having an almost the same area as the LCD panel is disposed underneath the LCD panel to irradiate light directly to the surface of the LCD panel.

The LCD backlight adopts a fluorescent lamp or a light emitting diode as alight source. The fluorescent lamp includes Cold Cathode Fluorescent Lamp (CCFL), External Electrode Fluorescent Lamp (EEFL) and the like depending on the driving method. Such a fluorescent lamp generates electric discharge in response to power application to emit light. In order to maintain the electric discharge, the fluorescent lamp requires an alternate current. An inverter receives and converts a direct current into an alternative current, supplying the alternative current to the fluorescent lamp.

FIG. 1 is a circuit diagram illustrating an LCD backlight inverter for generating a Pulse Width Modulation (PWM) control signal according to the prior art.

As shown in FIG. 1, the conventional LCD backlight inverter includes an error detector 110 and a PWM comparator 120. The error detector 110 receives, by feedback, a feedback reference voltage indicating the size of current supplied to a lamp and compares the feedback voltage with a reference voltage to convert the difference into an error signal. A PWM comparator 120 compares the error signal with a triangle-wave oscillation signal to output a PWM signal with a predetermined duty ratio.

In the conventional LCD backlight inverter, the feedback reference voltage S11 and the reference voltage S12 are inputted to the error detector 110 and the difference between the two is amplified to generate the error signal S13. The error signal S13 is fed back to the error detector 110 via a capacitor 111.

Then, the error signal S13 is inputted to a PWM comparator 120, which compares the error signal S13 with a triangle-wave oscillation signal S14 separately inputted, thereby generating a PWM control signal S15.

The duty ratio of the PWM control signal S15 is determined by the error signal S13 of the error detector 110, and in accordance with the duty ratio, the current flowing to the fluorescent lamp (not shown) varies. The current of the fluorescent lamp is fed back to the error detector 110 as a feedback reference voltage S11 so as to regulate the current flowing to the lamp.

In the conventional LCD backlight inverter, however, the error signal S13 suddenly increases due to sudden increase of the PWM duty ratio during the initial driving. This results in application of over-voltage or over-current to the fluorescent lamp, damaging the fluorescent lamp.

SUMMARY OF THE INVENTION

The present invention has been made to solve the foregoing problems of the prior art and therefore an aspect of the present invention is to provide a Liquid Crystal Display (LCD) backlight inverter which employs a soft starter to prevent over-current and over-voltage from being applied and to ensure stable supply of initial current and voltage to an LCD backlight lamp, thereby obviating damage to the LCD backlight lamp.

According to an aspect of the invention, the invention provides a Liquid Crystal Display (LCD) backlight inverter, which generates a pulse width modulation control signal to regulate the magnitude of driving power of an LCD backlight lamp. The LCD backlight inverter includes: a soft starter for generating a soft-start reference voltage gradually increasing as the driving power begins to be supplied; a first error detector for receiving a first feedback voltage indicating the magnitude of driving current of the lamp and for comparing a smaller value out of a predetermined first reference voltage and the soft-start reference voltage with the first feedback voltage to generate a first error signal corresponding to the difference between the smaller value and the soft-start reference voltage; and a pulse width modulation comparator for comparing the first error signal and a triangle wave oscillation signal to output the pulse width modulation control signal with a predetermined duty ratio.

According to an embodiment of the present invention, the soft starter includes: a switch connected to one end of a power source, the switch being turned on as the driving power is supplied to the lamp; and a capacitor connected between the other end of the switch and a ground, wherein the soft-starter provides the voltage generated at a connection point of the switch and the capacitor as the soft-start reference voltage.

According to an embodiment of the present invention, the LCD backlight inverter further includes: a second error detector for receiving a second feedback voltage indicating the magnitude of driving voltage of the lamp and for comparing a smaller value out of a predetermined second reference voltage and the soft-start reference voltage with the second feedback voltage to generate a second error signal corresponding to the difference between the smaller value and the soft-start reference voltage, wherein the pulse width modulation comparator compares a smaller value of the first error signal and the second error signal with the triangle-wave oscillation signal to determine the duty ratio of the pulse width modulation control signal.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
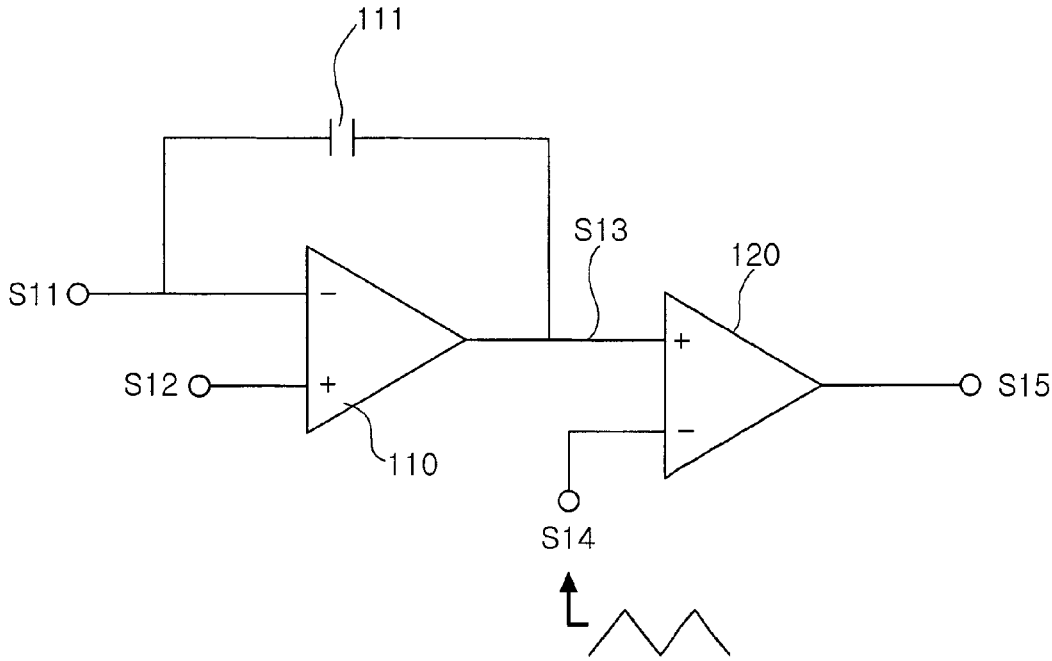
Prior art FIG. 1
FIG. 1 is a circuit diagram illustrating a conventional Liquid Crystal Display (LCD) backlight inverter for generating a Pulse Width Modulation (PWM) control signal.

Exemplary embodiments of the present invention will now be described in detail with reference to the accompanying drawings. This invention may however be embodied in many different forms and should not be construed as limited to the embodiments set forth herein. Rather, these embodiments are provided so that this disclosure will be thorough and complete, and will fully convey the scope of the invention to those skilled in the art. In the drawings, the same or similar components with substantially the same configurations and functions will be designated by the same reference numerals.

Figure 2:
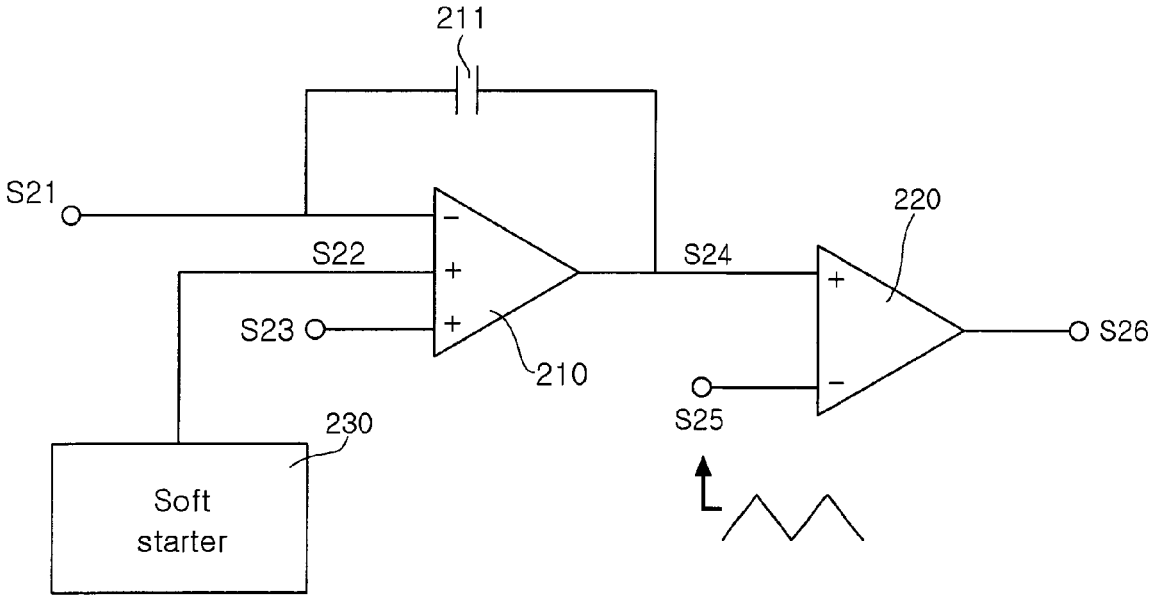
FIG. 2 is a circuit diagram illustrating an LCD backlight inverter for generating a PWM control signal according to an embodiment of the present invention.

FIG. 2 is a circuit diagram illustrating a Liquid Crystal Display (LCD) backlight inverter for generating a Pulse Width Modulation (PWM) signal according to the present invention.

As shown in FIG. 2, the LCD backlight inverter according to the present invention includes a soft starter 230 for generating a soft-start reference voltage S22 which gradually increases as driving power begins to be supplied to an LCD backlight lamp (not shown), a first error detector 210 for receiving a first feedback voltage S21 indicating the magnitude of driving current of the lamp (not shown) and for comparing a smaller value out of a predetermined first reference voltage S23 and the soft-start reference voltage S22 with the first feedback voltage S21 to generate a first error signal S24 corresponding to the difference between the smaller value and the first feedback voltage S21, and a PWM comparator 220 for comparing the first error signal S24 with a triangle-wave oscillation signal S25 to output a PWM control signal with a predetermined duty ratio.

Figure 3:
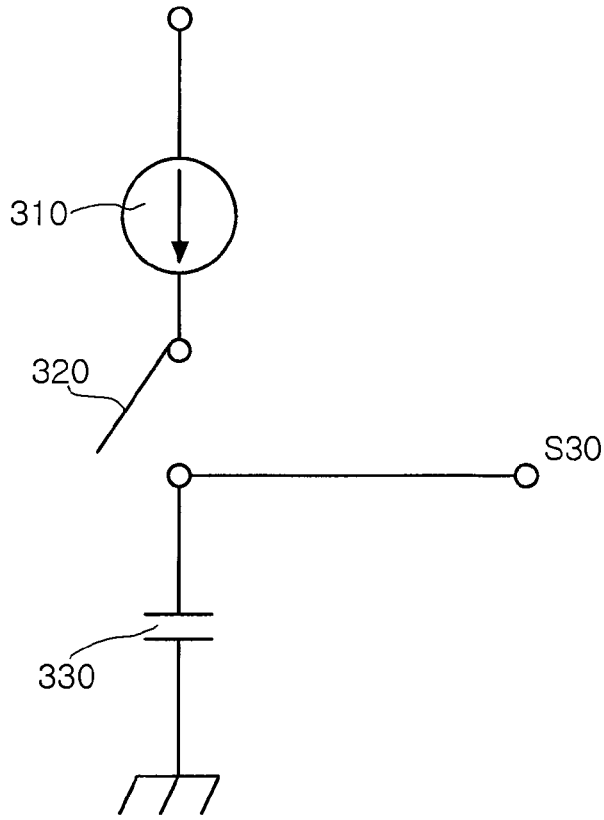
FIG. 3 is a circuit diagram illustrating a soft starter of the LCD backlight inverter according to an embodiment of the present invention.

FIG. 3 is a circuit diagram illustrating the soft-starter of the LCD backlight inverter according to an embodiment of the present invention.

As shown in FIG. 3, the soft starter 230 of the LCD backlight inverter according to an embodiment of the present invention includes a switch 320 connected to one end of a power source 310 and turned on as the driving power is supplied to the lamp, and a capacitor 330 connected between the other end of the switch 320 and a ground.

Figure 4:
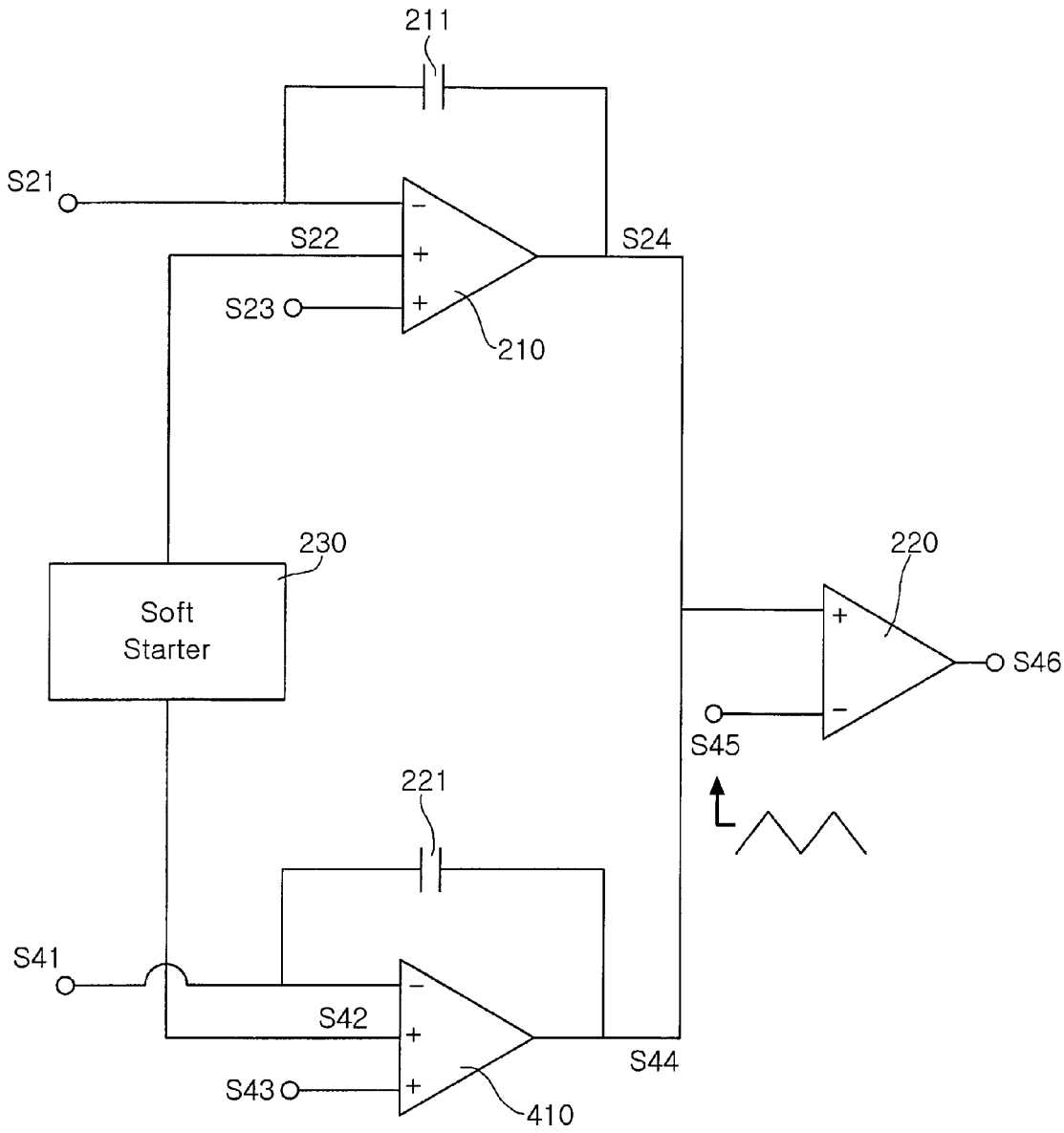
FIG. 4 is a circuit diagram illustrating an LCD backlight inverter for generating a PWM control signal according to another embodiment of the present invention.

FIG. 4 is a circuit diagram illustrating an LCD backlight inverter for generating a PWM control signal according to another embodiment of the present invention.

As shown in FIG. 4, the LCD backlight inverter according to another embodiment of the present invention further includes a second error detector 410 for receiving a second feedback voltage S41 indicating the magnitude of driving voltage of the lamp and for comparing a smaller value out of a predetermined second reference voltage S43 and the soft-start reference voltage S42 with the second feedback voltage S41 to generate a second error signal S44 corresponding to the difference between the smaller value and the second feedback voltage S41.

Now, the operation and effects of the LCD backlight inverter according to the present invention will be explained with reference to the drawings.

As shown in FIG. 2, the first error detector 210 receives three inputs including a first input of the first feedback voltage S21 indicating the magnitude of the driving current of the lamp by feedback, a second input of the soft-start reference voltage S22 and a third input of the predetermined first reference voltage S23. The first error detector 210 compares a smaller value out of the soft-start reference voltage S22 and the first reference voltage S22 with the first feedback voltage S21 to output the first error signal S24 corresponding to the difference between the smaller value and the first reference voltage S22. The first error signal S24 is fed back as the first input S21 via a capacitor 211. The first error signal S24 is an error signal for the driving current of the lamp.

The soft-start reference voltage S22 generated from the soft starter 230 gradually increases once the driving power begins to be supplied to the lamp, and thus has a smaller value than the first reference voltage S23 for a predetermined period of time (hereinafter, referred to as "transitional period") from the point where the driving power begins to be supplied to the lamp. Therefore, the first error detector 210 compares the first feedback voltage S21 with the soft-start reference voltage S22 to generate the first error signal corresponding to the difference during the transitional period. Once the transitional period has passed, the first reference voltage S23 has a smaller value than the soft-start reference voltage S22, and thus the first error detector 210 compares the first feedback voltage S21 with the first reference voltage S23 to generate the first error signal S24 corresponding to the difference.

Therefore, during the transitional period, the first error signal S24 is generated corresponding to the difference between the first feedback voltage S21 and the gradually increasing soft-start reference voltage S22, and accordingly, the first error signal S24 also gradually increases in the same manner as the soft-start reference voltage S22.

According to an embodiment of the present invention, in the soft starter 230 as shown in FIG. 3, the capacitor 330 is charged by the switch 320 which is turned on as the driving power is supplied to the LCD backlight lamp, thereby gradually increasing the voltage at the connection point of the switch 320 and the capacitor 330. The soft starter 230 supplies this voltage as the soft-start reference voltage S30.

The PWM comparator 220 compares the first error signal S24, generated by the first error detector 210, for the current of the lamp with the triangle-wave oscillation signal S25 to generate the PWM control signal S26. As the first error signal S24 gradually increases during the transitional period, the duty ratio of the PWM control signal S26 generated from comparing the first error signal S24 with the triangle-wave oscillation signal S25 gradually changes in the same manner.

For example, a duty ratio gradually increases from a low value during the transitional period to reach a predetermined value after the transitional period. Thus, the driving current is supplied to the lamp according to the low value of the duty ratio, preventing application of over-current and allowing application of gradually increasing current to the lamp during the transitional period. This precludes flow of over-current to the LCD backlight lamp.

Now, the operation and effects of the LCD backlight inverter including the second error detector capable of preventing over-voltage from being applied to the lamp, according to another embodiment of the present invention, will be examined.

As shown in FIG. 4, the second error detector 410 of the LCD backlight inverter according to another embodiment of the present invention receives three inputs including a first input of the second feedback voltage S41 indicating the magnitude of driving voltage of the lamp, by feedback, a second input of the soft-start reference voltage S42 and a third input of the predetermined second reference voltage S43. The second error detector 410 compares a smaller value out of the soft-start reference voltage S42 and the second reference voltage S43 with the second feedback voltage S41 to output the second error signal S44 corresponding to the difference. The first error signal S44 is fed back as the first input S41 via a capacitor 411. The second error signal S44 is an error signal for the driving voltage of the lamp.

The soft-start reference voltage S42 supplied by the soft starter 230 can be identical to the soft-start reference voltage S22 of the first error detector.

The soft-start reference voltage S42 generated at the soft starter 230 gradually increases as the driving power begins to be supplied to the lamp, and thus has a value smaller than the first reference voltage S23 during the transitional period. Thus, the second error detector 410 compares the second feedback voltage S41 and the soft-start reference voltage S42 to generate the second error signal S44 corresponding to the difference during the transitional period. Once the transitional period has passed, the second reference voltage S43 has a value smaller than that of the soft-start reference voltage S42, and thus the second error detector 210 compares the second feedback voltage S41 with the second reference voltage S43 to generate the second error signal S44 corresponding to the difference.

Therefore, during the transitional period, the second error signal S44 is generated from comparison between the second feedback voltage S41 and the gradually increasing soft-start reference voltage S42, and thus the second error signal S24 gradually increases in the same manner as the soft-start reference voltage S22.

As described above, the operation of the second error detector 410 not only prevents the driving voltage from being excessively applied to the lamp during the transitional period, but also prevents a large driving voltage from being applied and damaging the LCD backlight in a case where the LCD backlight is driven without the lamp (with the lamp open).

The PWM comparator 220 of the LCD backlight inverter according to another embodiment of the present invention compares a smaller value out of the first error signal S24, generated by the first error detector 210, for the current of the lamp and the second error signal S44, generated by the second error detector 410, for the voltage of the lamp with a triangle-wave oscillation signal S46 with a predetermined duty ratio.

As just described, the PWM comparator 220 compares the smaller value out of the first error signal S24, outputted from the first error detector 210, for the driving current of the lamp and the second error signal S44, outputted from the second error detector 410, for the driving voltage of the lamp with the triangle-wave oscillation signal S45. Here, if over-current is applied to the lamp, the first error signal S24 has a larger value than the second error signal S44, and thereby a corresponding PWM control signal S46 is outputted. On the other hand, if over-current is applied to the lamp or the lamp is open, the second error signal S44 has a larger value than the first error signal S24, and thereby a corresponding PWM control signal S46 is outputted.

That is, when driving power is applied to the lamp, not only when there is a defect in the driving current but also when there is a defect in the driving voltage applied to the lamp, the soft-start reference voltage S22 and S42 generated from the soft starter 230 is compared with the first feedback voltage S21 and the second feedback voltage S41, respectively, to generate the PWM control signal S46. This prevents application of over-current and over-voltage to the lamp during the initial driving of the lamp.

Figure 5:
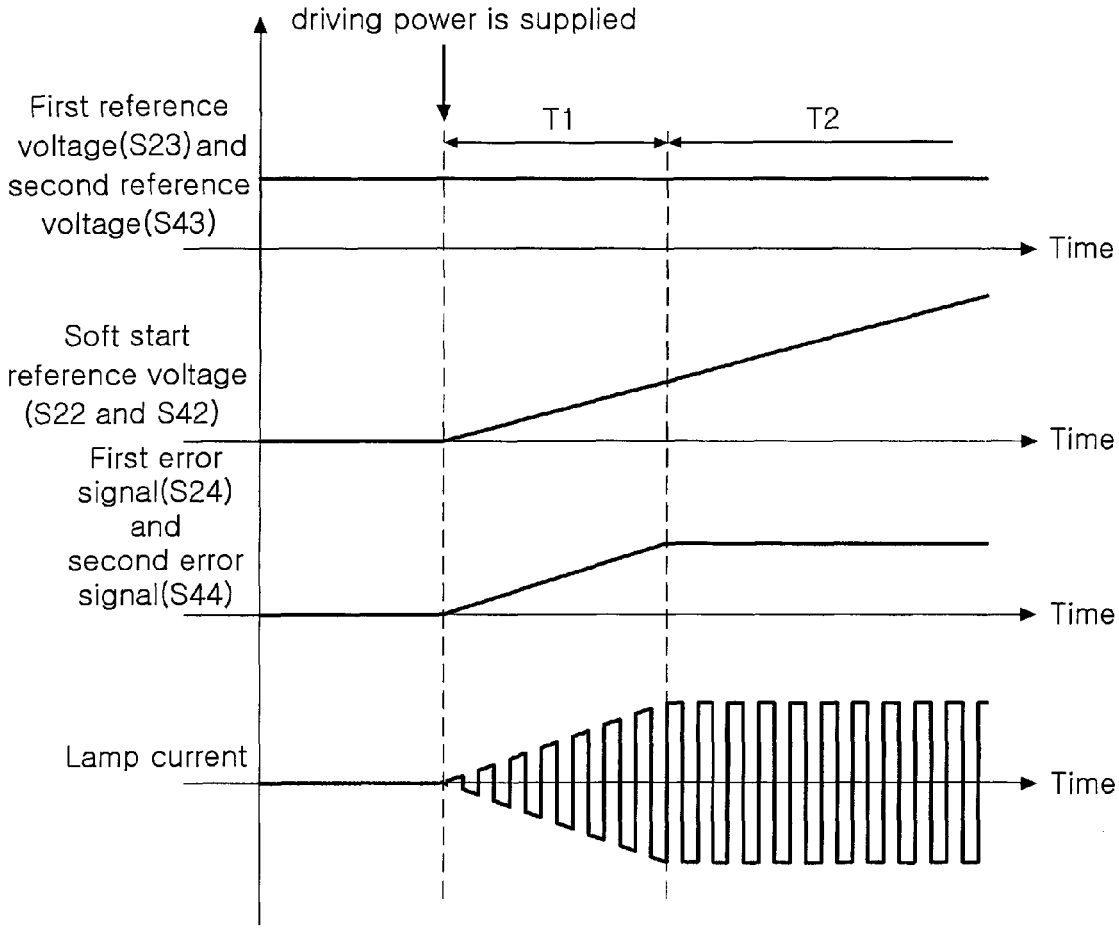
FIG. 5 is a waveform diagram for explaining the operation of the LCD backlight inverter according to the present invention.

FIG. 5 is a waveform diagram for explaining the operation of the LCD backlight inverter according to the present invention.

The first reference voltage S23 and the second reference voltage S43 respectively determining the current and voltage of the driving power of the LCD backlight lamp have predetermined values regardless of time. The first reference voltage S23 and the second reference voltage S43 can have different values, and although illustrated as the same value in FIG. 5, this does not limit the present invention.

The switch 320 of the soft starter 230 is turned 'on' as the driving power is supplied to the LCD backlight lamp. The voltage is gradually increased and supplied as the capacitor 330 is charged. Thus, the soft-start reference voltage S22 and S42 gradually increases after the driving power begins to be applied to the lamp as shown in FIG. 5.

Once the driving voltage begins to be supplied to the LCD backlight lamp, the first error detector 210 and the second error detector 240 compares the soft-start reference voltage S22 and S42 with the first feedback voltage S21 and the second feedback voltage S41, respectively, thereby outputting the differences as the first error signal S24 and the second error signal S44 until the soft-start reference voltage S22 and S42 catches up with the first reference voltage S23 and the second reference voltage S43 or during the transitional period T1. Once the soft-start reference voltage S22 and S42 catches up with the first reference voltage S23 and the second reference voltage S43, T2, the first error detector 210 and the second error detector 240 compares the first reference voltage S23 and the second reference voltage S43 with the first feedback voltage S21 and the second feedback voltage S41, respectively, outputting the differences as the first error signal S24 and the second error signal S44. Therefore, the first error signal S24 and the second error signal S44 have the waveforms as shown in FIG. 5.

The transitional periods T1 can be different for the first error detector 210 and the second error detector 410, and FIG. 5 is only exemplary.

The first error signal S24 and the second error signal S44 are transmitted to the PWM comparator 220 and a smaller one of the two signals S24 and S44 is compared with the triangle-wave oscillation signal S45. The duty ratio of the PWM control signal S46 is determined in such a way that the current or voltage of the LCD backlight lamp is gradually increased during the transitional period T1. Once the transitional period has passed T2, the duty ratio of the PWM control signal S46 is determined in such a way that the current or voltage of the LCD backlight lamp is maintained at a predetermined value. Thus, the current with the waveform shown in FIG. 5 runs through the LCD backlight.

With such operation as described above, the LCD backlight lamp is prevented from being applied with over-current and over-voltage during its initial driving.

According to the present invention as set forth above, an LCD backlight inverter has a soft starter which prevents application of over-current during the initial driving of the LCD backlight, allowing the current to be supplied without any peaks, ultimately preventing damage to the LCD backlight and prolonging the lifetime of the LCD backlight.

Further, the LCD backlight inverter according to the present invention prevents application of over-voltage to the backlight during the initial driving of the LCD backlight lamp, and application of over-voltage when the lamp is open, thereby obviating damage to the backlight.

What is claimed is:

1. A liquid crystal display backlight inverter, which generates a pulse width modulation control signal to regulate the magnitude of driving power of a liquid crystal display backlight lamp, comprising:

a soft starter for generating a soft-start reference voltage gradually increasing as the driving power begins to be supplied;

a first error detector for receiving a first feedback voltage indicating the magnitude of driving current of the lamp and for comparing a smaller value out of a predetermined first reference voltage and the soft-start reference voltage with the first feedback voltage to generate a first error signal corresponding to the difference between the smaller value and the soft-start reference voltage; and a pulse width modulation comparator for comparing the first error signal and a triangle wave oscillation signal to output the pulse width modulation control signal with a predetermined duty ratio.

2. The liquid crystal display backlight inverter according to claim 1, wherein the soft starter comprises:

a switch connected to one end of a power source, the switch being turned on as the driving power is supplied to the lamp; and a capacitor connected between the other end of the switch and a ground, wherein the soft-starter provides the voltage generated at a connection point of the switch and the capacitor as the soft-start reference voltage.

3. The liquid crystal display backlight inverter according to claim 1, further comprising:

a second error detector for receiving a second feedback voltage indicating the magnitude of driving voltage of the lamp and for comparing a smaller value out of a predetermined second reference voltage and the soft-start reference voltage with the second feedback voltage to generate a second error signal corresponding to the difference between the smaller value and the soft-start reference voltage, wherein the pulse width modulation comparator compares a smaller value of the first error signal and the second error signal with the triangle wave oscillation signal to determine the duty ratio of the pulse width modulation control signal.

* * * * *